US010006728B2

(12) United States Patent
Bailey

(10) Patent No.: US 10,006,728 B2
(45) Date of Patent: Jun. 26, 2018

(54) AMBIDEXTROUS CHARGING HANDLE

(71) Applicant: Chris Bailey, Littleton, CO (US)

(72) Inventor: Chris Bailey, Littleton, CO (US)

( * ) Notice: Subject to any disclaimer, the term of this patent is extended or adjusted under 35 U.S.C. 154(b) by 170 days.

(21) Appl. No.: 15/201,648

(22) Filed: Jul. 5, 2016

(65) Prior Publication Data

US 2018/0010868 A1 Jan. 11, 2018

(51) Int. Cl.
*F41A 3/72* (2006.01)
*F41A 35/06* (2006.01)
*F41A 5/26* (2006.01)

(52) U.S. Cl.
CPC ..... *F41A 3/72* (2013.01); *F41A 5/26* (2013.01); *F41A 35/06* (2013.01)

(58) Field of Classification Search
CPC ..... F41A 3/72; F41A 5/26; F41A 35/06
See application file for complete search history.

(56) References Cited

U.S. PATENT DOCUMENTS 4,821,621 A * 4/1989 Lorenzo ..... F41A 3/64 89/143
7,240,600 B1 * 7/2007 Bordson ..... F41A 3/72 42/69.01
7,798,045 B1 * 9/2010 Fitzpatrick ..... F41A 21/481 42/69.02
9,482,479 B1 * 11/2016 Jen ..... F41A 3/72
9,488,424 B1 * 11/2016 Kincel ..... F41A 3/72
9,677,833 B2 * 6/2017 Kincel ..... F41A 3/72
9,759,502 B2 * 9/2017 Sugg ..... F41A 3/72
2013/0092014 A1 * 4/2013 Kincel ..... F41A 3/72 89/1.4
2014/0060293 A1 * 3/2014 Gomez ..... F41A 3/72 89/1.4
2015/0233657 A1 * 8/2015 Barker ..... F41A 3/72 89/1.4
2016/0102938 A1 * 4/2016 Sroufe ..... F41A 3/72 42/16
2016/0178298 A1 * 6/2016 Daniel ..... F41A 3/72 89/1.4
2016/0298917 A1 * 10/2016 Hwang ..... F41A 35/06

FOREIGN PATENT DOCUMENTS

WO WO-2016193841 A1 * 12/2016 ..... F41A 9/59

* cited by examiner

*Primary Examiner* — Christopher R Harmon
(74) *Attorney, Agent, or Firm* — Joseph Beckman

(57) ABSTRACT

This invention relates to the design and construction of a novel ambidextrous charging handle designed to vent discharge gases in the operation of a gas impingement or piston driven firearm.

5 Claims, 6 Drawing Sheets

AMBIDEXTROUS CHARGING HANDLE

FIELD OF THE INVENTION

This invention relates to the design and construction of a novel ambidextrous charging handle designed to vent discharge gases in the operation of a gas impingement or piston driven firearm.

BACKGROUND OF THE INVENTION

The present invention describes a novel ambidextrous charging handle specially designed to vent discharge gases.

Various charging handles have been designed to improve upon the military specification (milspec) charging handle in use on the M16/M4/AR15 family of firearms for many decades. The milspec charging handle includes a latch designed to be disengaged solely via gripping the t-grip on its left side. The milspec charging handle further includes no provision to vent gases. The use of firearm suppressors on such a firearm results in increased back pressure and venting of discharge gases out the back end of the firearm receiver along the axis of the charging handle stem. This undesired gas discharge may injure or disorient the shooter or otherwise interfere with optimum operation of the firearm. Such an event may also occur in the event of a ruptured ammunition cartridge case.

In light of the foregoing, various manufacturers have designed charging handles for ambidextrous use or for controlling the venting of discharge gases. U.S. Pat. No. 6,311,603 to Dunlap describes a charging handle including a gas tube for directing powder gases. The '603 charging handle includes grooves and gas deflecting surfaces which amount to a raised shelf on the charging handle t-grip and gas channels within the t-grip portion to direct gases to the side (parts 84 and 98 ). The '603 charging is not ambidextrous. It also does not include an integral shroud, which in testing, proves superior to the addition of a '603 styled shelf to inhibit rearward gas discharge.

Ambidextrous designs can be found in U.S. Pat. Nos. 8,960,066 to Gomez and 9,222,738 to Asher. The '738 patent utilizes a t-grip incorporating a latch mechanism with a thumbpad, enabling ambidextrous use. As with most charging handles, upon operation of the charging handle by drawing the charging handle rearward, vector forces are applied out of line with the axis of the stem and firearm receiver, increasing friction and wear on both the charging handle and the inside of the firearm receiver. There are no provisions to control the venting of gas discharge.

The '066 patent design utilizes two independently retractable handles comprising its t-grip assembly. Each handles utilizes pivot assemblies. The drawbacks to utilizing pivoting handles is twofold. As in the '738 patent, vector forces are applied out of line with the axis of the stem and firearm receiver. Furthermore, in the event the charging handle is needed to "mortar" the firearm, the forces incurred are directed upon the handle pivots and retaining pins rather than aligned with the charging handle stem. "Mortaring" is forcefully striking the firearm stock down, muzzle up on a hard surface while pulling on the charging handle to dislodge a stuck round of ammunition and/or to forcefully retract the firearm bolt carrier assembly due to malfunction. In such an instance, the mechanical integrity of the charging handle is fully tested. Finally, there are no provisions to control the venting of gas discharge.

All the foregoing, in addition to milspec designs, also tend to expose the charging handle mechanisms to the environment. Exposure of the mechanisms allows dirt, sand or other environmental contaminants to interfere with the operation of the charging handle or to accelerate wear of the charging handle components.

In view of the prior arts' shortcomings, it is thus desirable to create a charging handle for a gas impingement firearm which is designed for ambidextrous use while maintaining the strongest structural integrity while shielding the charging handle mechanisms from environmental contaminants or damage. It is also desirable that such a handle be designed to allow the force of charging the firearm to be directed along the same axis of travel as the charging handle stem to minimize wear on the handle and firearm upper receiver and to reduce the chance of charging handle damage. Finally, it is desirable that such a handle also be designed to handle the venting of discharge gases in such a manner that the gases are directed in line with the recoil of the firearm while being maximally contained to prevent interference with the operator's handling of the firearm by preventing venting in or near the operator's face.

Figure 1:
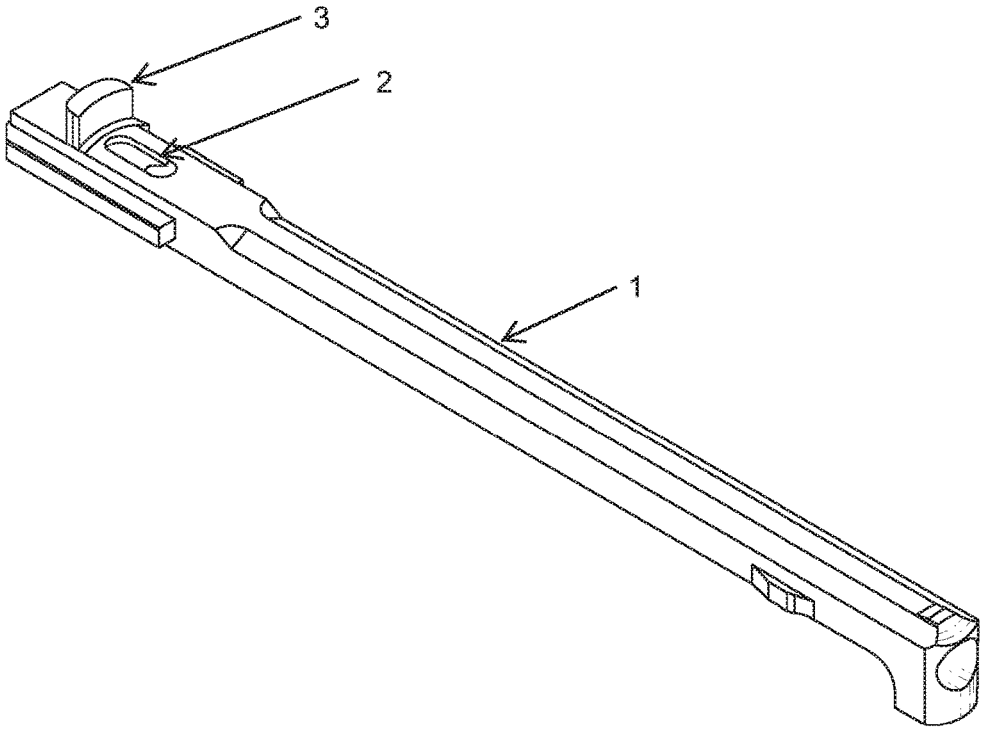
FIGS. 1-7 are various views of parts, the completed assembly or exploded views of the charging handle.

DETAILED DESCRIPTION OF THE INVENTION:

Shown in FIG. 1 is the charging handle stem (1). FIG. 1 discloses the gas discharge port (2) and gas barrier (3).

Figure 2:
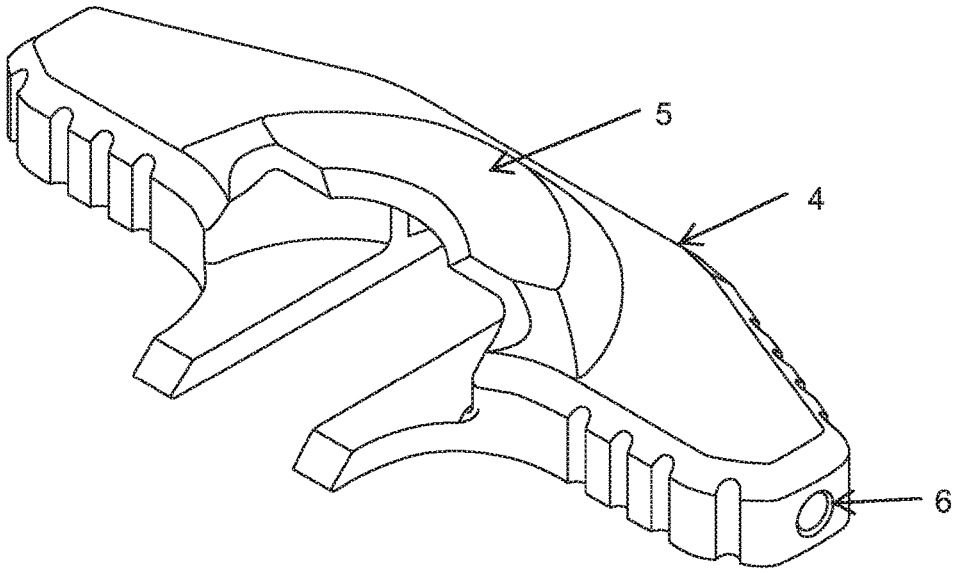

FIG. 2 is the upper t-grip (4). FIG. 2 discloses the gas shroud (5) and t-grip upper and lower assembly pin holes (6).

Figure 3:
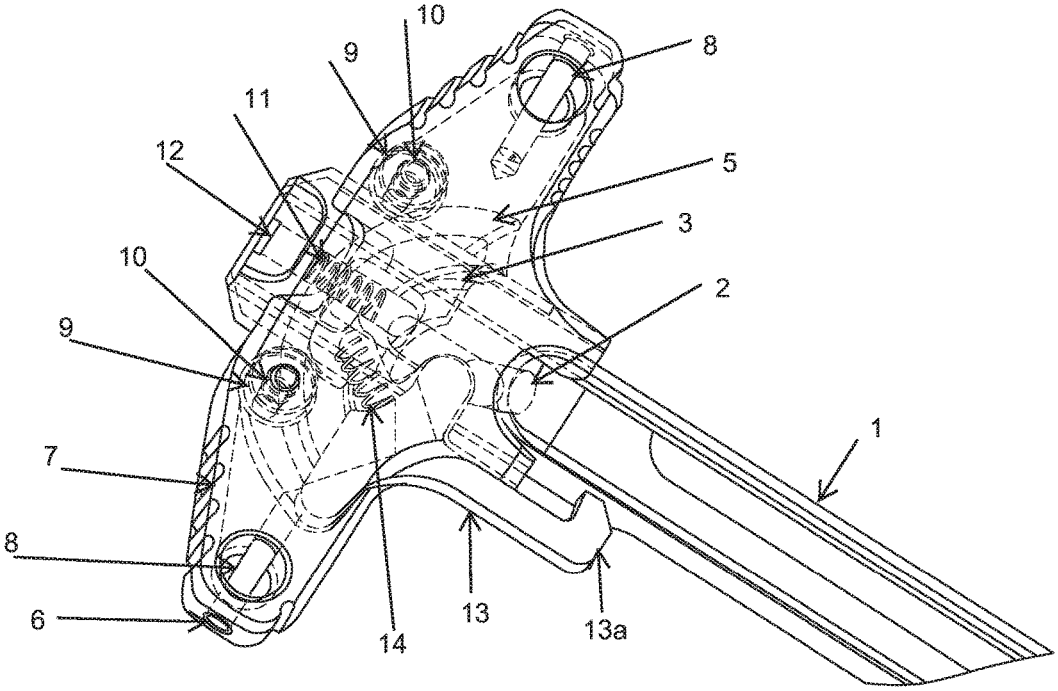

FIG. 3 is an assembled view of the charging handle disclosing the structural relationship between all features of the invention. The view is from the bottom of the charging handle. Disclosed is the rear portion of the stem (1) in relation to the t-grip assembly (lower t-grip (7) shown). The rear most portion of the stem is shown extending beyond the t-grip. Also disclosed is the relationship of the upper and lower t-grip assemblies secured by pins (8) located on both ends of the t-grip assembly in pin holes (6). Guide rollers (9) with guide roller pins (10), to direct movement of the t-grip assembly parallel with the charging handle stem during operation are disclosed. Return spring (11) and return spring retainer (12), to return the t-grip assembly to a ready position on the charging handle stem are disclosed. The latch (13) is disclosed in a spring-biased closed position by virtue of latch spring (14). Disclosed in dotted lines are the gas discharge port (2), gas barrier (3) and gas shroud (5).

Figure 4:
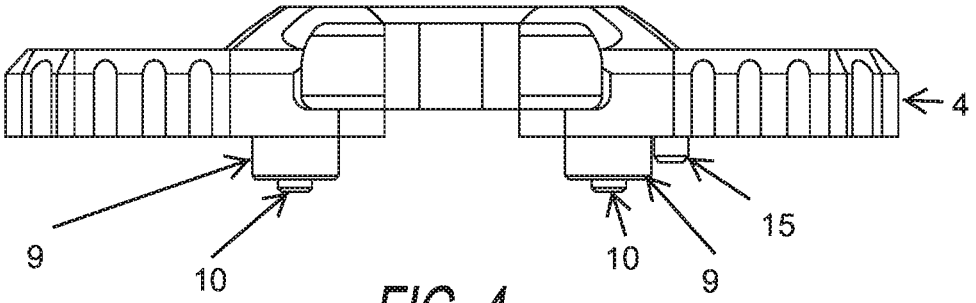

FIG. 4 is the upper t-grip assembly (4). Disclosed are the guide rollers (9) with guide roller pins (10). The guide rollers act to keep the t-grip assembly aligned with the stem and to direct the force of operation axially in line with the stem to reduce friction and wear. Latch pivot pin (15) is also shown.

Figure 5:
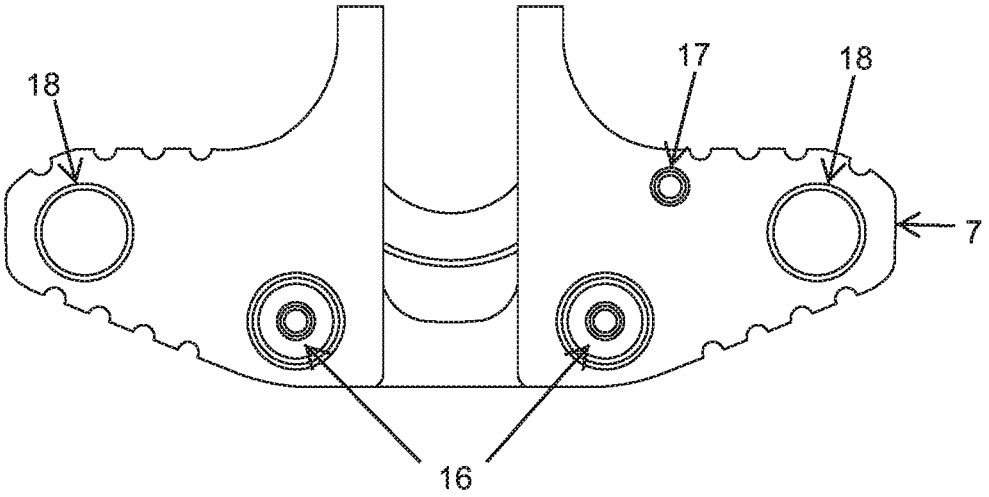

FIG. 5 is the lower t-grip assembly (7). Shown are the mating holes (16) for the guide roller pins (10), mating hole (17) for the latch pivot pin (15) and t-grip assembly pins (18) for mating upper t-grip (4) with lower t-grip (7) via t-grip mating holes (19).

Figure 6:
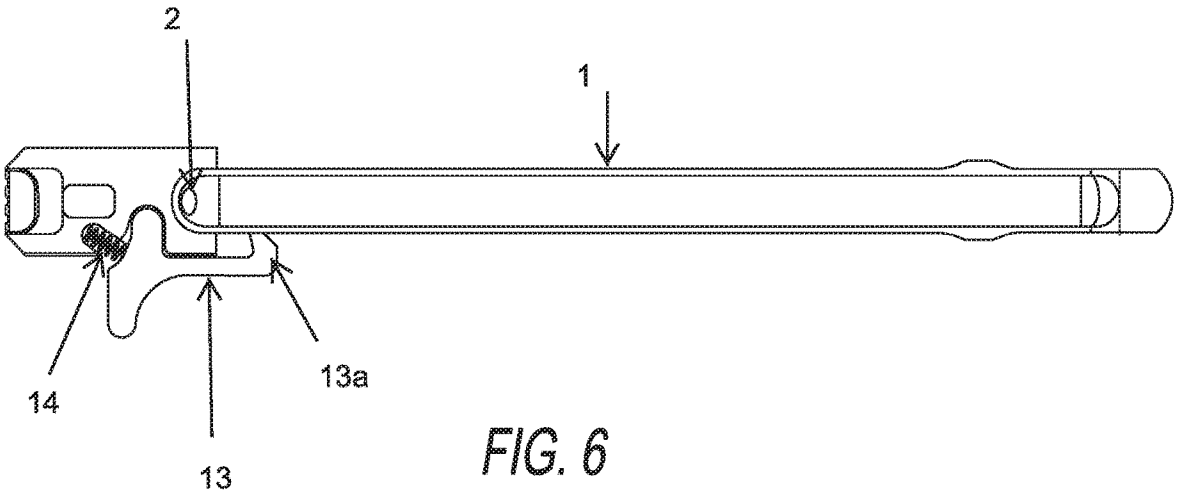

FIG. 6 depicts the charging handle stem (1) in combination with latch (13), latch spring (14). Also disclosed is one end of gas discharge port (2). The latch includes a protruding member portion to pivot the latch to an open position via the latch pivot pin and a hook portion (13*a*) for engaging the firearm receiver when in a closed position. No part of the latch constitutes a part of the t-grip handle nor is directly actuated by the operator, reducing the likelihood of excessive force acting upon the latch pin as in prior art designs.

Figure 7:
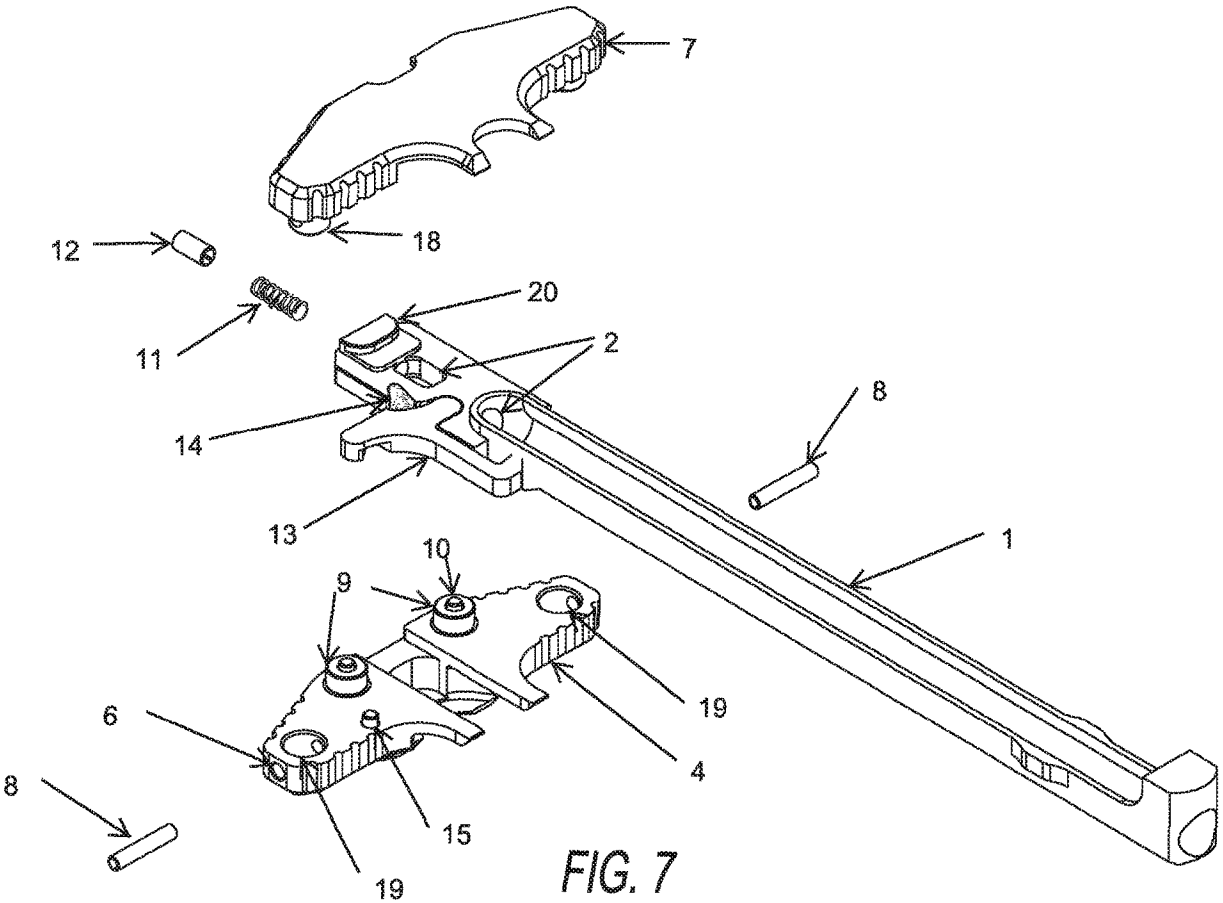

FIG. 7 depicts an exploded view of the ambidextrous charging handle as viewed from the bottom. Shown are stem (1) and upper t-grip (4). Upper t-grip(4) clearly shows t-grip mating holes (19), guide rollers (9) with guide roller pins (10) and latch pivot pin (15). On assembly, upper t-grip (4)and lower t-grip (7) are joined together by mating t-grip assembly pins (18) with t-grip mating holes (19) and securing by pins (8) located on both ends of the upper t-grip assembly in pin holes (6). FIG. 7 further discloses the gas discharge port as viewed from the underside of stem (1), latch (13), latch spring (14), return spring (11), return spring retainer (12) and t-grip stop (20).

As indicated or suggested in FIGS. 2-5 and FIG. 7 the upper t-grip and lower t-grip, when assembled on the stem, constitute a single integral grip rather than two separate handles. The t-grip assembly also moves independently of the stem and axially in line with the stem and firearm receiver during operation.

While the dimensions and shape of the various parts are shown and discussed herein, such dimensions and shape may be adjusted or modified to meet industry needs or requirements without digressing from the spirit of the invention.

What is claimed:

1. An ambidextrous charging handle for a firearm comprising:

a central stem for riding within the firearm receiver and engaging the firearm bolt carrier assembly;

said stem comprising a gas discharge port to direct firearm gases, said gas discharge port originating on the underside of said stem and exiting on the top side of said stem at a rearward port of said stem;

said stem further comprising an integral gas barrier located approximate the gas discharge port exit;

a latch at a rear portion of said stem, said latch designed to engage said firearm receiver while in a closed position and said latch including a protruding member on a rearward portion of said latch to pivot said latch to an open position when pulling on said charging handle;

a t-grip assembly for moving said charging handle along the firearm axis to engage the firearm bolt carrier assembly, said t-grip assembly comprising an upper t-grip and a lower t-grip; and a first guide roller and a second guide roller, said guide rollers integral with the t-grip assembly and positioned on a first and second side of said stem such that said t-grip assembly is guided along the stem axis when operated.

2. An ambidextrous charging handle for a firearm comprising:

a central stem for riding within the firearm receiver and engaging the firearm bolt carrier assembly;

said stem comprising a gas discharge port to direct firearm gases, said gas discharge port originating on the underside of said stem and exiting on the top side of said stem at a rearward port of said stem;

said stem further comprising an integral gas barrier located approximate the gas discharge port exit;

a latch at a rear portion of said stem, said latch designed to engage said firearm receiver while in a closed position and said latch including a protruding member on a rearward portion of said latch to pivot said latch to an open position when pulling on said charging handle;

a t-grip assembly for moving said charging handle along the firearm axis to engage the firearm bolt carrier assembly, said t-grip assembly comprising an upper t-grip and a lower t-grip;

wherein the t-grip assembly further comprises an integral gas shroud atop the upper t-grip, said gas shroud dimensioned to surround said gas barrier; and further comprising a first guide roller and a second guide roller, said guide rollers integral with the t-grip assembly and positioned on a first and second side of said stem such that said t-grip assembly is moved along the stem axis when operated.

3. The ambidextrous charging handle of claim 2 further comprising a first t-grip assembly pin and a second t-grip assembly pin, each pin located at a distal end of either the upper t-grip or lower t-grip; said pins dimensioned to mate with corresponding t-grip mating holes in the upper t-grip or lower t-grip and secured by a first pin dimensioned to fit a first pin hole in one end of the t-grip assembly and by a second pin dimensioned t fit a second pin hole in a second end of the t-grip assembly.

4. The ambidextrous charging handle of claim 3 wherein said stem further comprises an integral t-grip stop to limit t-grip rearward travel and provide for operation of said charging handle upon the firearm bolt carrier assembly.

5. The ambidextrous charging handle of claim 4 wherein the gas barrier encompasses approximately 60-70% of the interior surface area of the t-grip gas shroud.

* * * * *